US008776545B2

(12) United States Patent
Blockerye

(10) Patent No.: US 8,776,545 B2
(45) Date of Patent: Jul. 15, 2014

(54) HEAT EXCHANGER COOLED BY AIR FITTED WITH A RIGID PANEL FORMING A WINDSCREEN

(75) Inventor: Serge Blockerye, Hennuyeres (BE)

(73) Assignee: Laborelec CVBA, Linkebeek (BE)

( * ) Notice: Subject to any disclaimer, the term of this patent is extended or adjusted under 35 U.S.C. 154(b) by 352 days.

(21) Appl. No.: 13/212,332

(22) Filed: Aug. 18, 2011

(65) Prior Publication Data

US 2012/0043061 A1 Feb. 23, 2012

(30) Foreign Application Priority Data

Aug. 19, 2010 (EP) ..... 10305902

(51) Int. Cl.
*F25D 19/00* (2006.01)

(52) U.S. Cl.
USPC ..... 62/455

(58) Field of Classification Search
USPC ..... 62/455, 502, 513; 165/104.34
See application file for complete search history.

(56) References Cited

U.S. PATENT DOCUMENTS 3,939,906 A 2/1976 Rothenbucher
6,450,878 B1 * 9/2002 Vincent ..... 454/139
2005/0006050 A1 1/2005 Schrey et al.
2008/0196435 A1 8/2008 Schulze
2009/0165993 A1 7/2009 Yang et al.

FOREIGN PATENT DOCUMENTS

DE 942636 5/1956
DE 20 2004 012 838 10/2004
EP 1798491 A1 * 12/2005
GB 903397 8/1962

* cited by examiner

*Primary Examiner* — Melvin Jones
(74) *Attorney, Agent, or Firm* — Preti Flaherty Beliveau & Pachios LLP

(57) ABSTRACT

The invention relates to a heat exchanger cooled by air (1) comprising a plurality of ventilation modules (104) arranged in several parallel rows, adjacent to one another and placed in the same horizontal plane to form a ventilation structure (100) which is spaced from the ground (S) so as to promote circulation of air under the ventilation structure. Each ventilation module comprises a fan (106) directed to suction air present below the ventilation structure and blow it vertically through heat exchange elements (204). The exchanger further comprises at least one rigid panel (300) forming a windscreen which extends vertically from a lateral edge of the ventilation structure to the ground at a height (h) between 5 and 50% of the distance separating the ventilation structure from the ground.

7 Claims, 2 Drawing Sheets

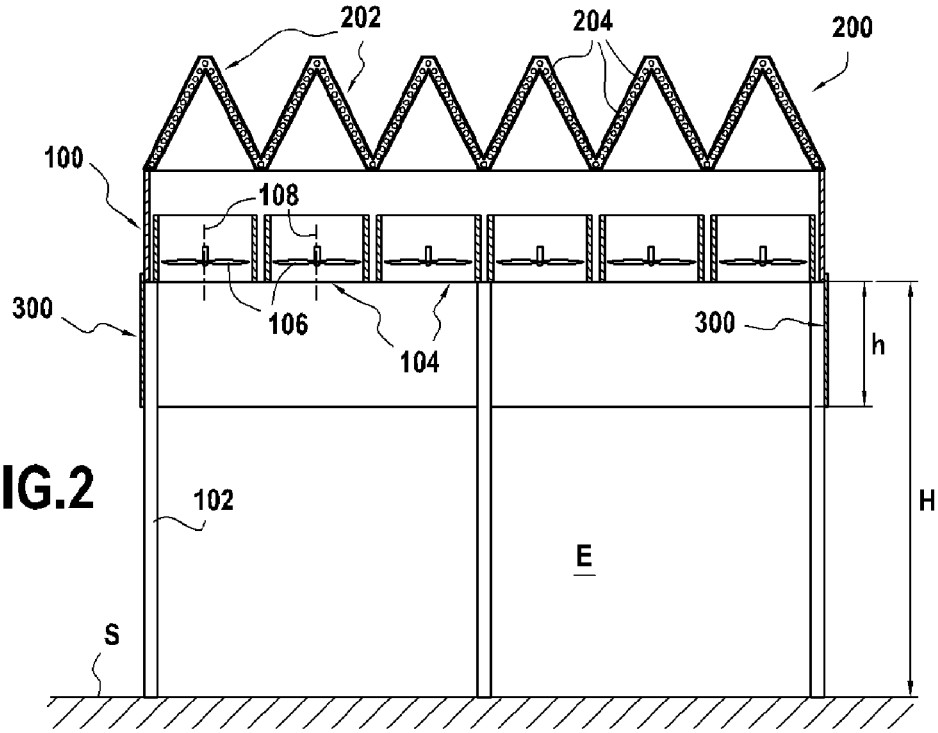
FIG.2
FIG.3A
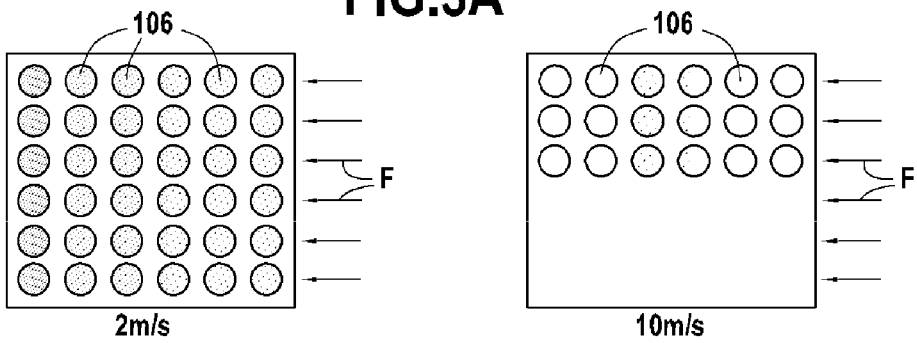
FIG.3B
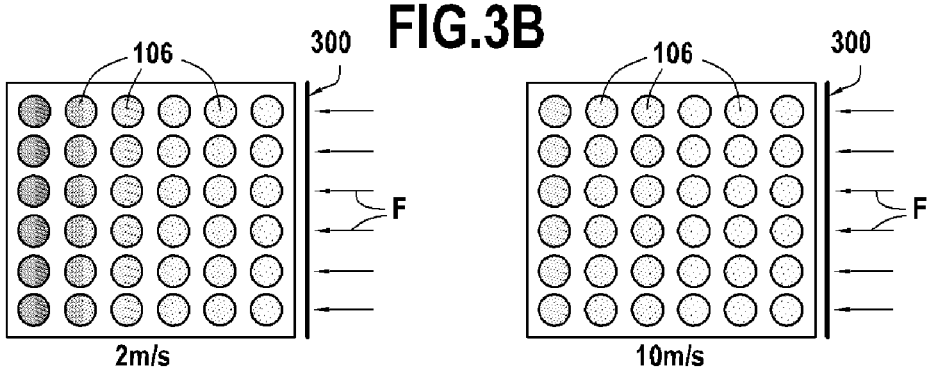

HEAT EXCHANGER COOLED BY AIR FITTED WITH A RIGID PANEL FORMING A WINDSCREEN

BACKGROUND OF THE INVENTION

The present invention relates to the general field of heat exchangers cooled by air.

The field of application of the invention is especially though not exclusively that of condensers cooled by air in thermal power stations.

Condensers cooled by air (also called aerocondensers or ACC for <<Air-Cooled Condenser>>) are used especially in thermal power stations for production of electricity for condenser, with the steam coming from the low-pressure turbine of the plant. ACC units are advantageous alternative to condensers cooled by water. In particular, in contrast to condensers cooled by water ACCs do not release any water steam into the atmosphere, have a limited height, and do not need to be close to a cold-water source (river or canal).

Typically, an ACC comprises a plurality of ventilation modules arranged in several parallel rows, adjacent to one another and placed in the same horizontal plane to form a ventilation structure which is spaced from the ground. Each ventilation module comprises a fan for suctioning air present below the ventilation structure and blowing it vertically through heat exchange tubes in which the steam coming from the low-pressure turbine of the thermal power station circulates.

The yield from a thermal power station depends on the efficacy of the ACC heat transfer. It has been noted that ACCs are highly sensitive to external weather conditions which can considerably degrade their performance in terms of heat and vacuum transfer produced inside the condenser (also called counter-pressure turbine). This is the case for example when the surrounding temperature is high, when winds intensify or when recirculation of warm air occurs.

More precisely, it has been noted that the performance of an ACC is all the lower when the wind is strong. In fact, strong winds circulating under the ventilation structure create local drops in pressure under the fans which decrease the airflow aspired by the latter, making thermal exchange less effective. The direction of the wind also plays an important role to the extent where dominant winds can be present, as a function of the implantation site of the plant.

Also, some obstacles such as surrounding buildings, steam conduits, tanks, etc. can influence air circulation at the ACC intake and be the origin of warm-air recirculation. In particular, warm air exiting the ACC can be redirected to the ACC intake and therefore aspirated again by the fans.

To counter these problems, different panels forming a windscreen have been developed. One of the known a windscreens consists of a panel having the form of a cross which is installed under the ventilation structure to divide the aspiration space of the fans into several zones compartmentalised relative to each other. The effect of this type of windscreen which extends vertically from the ground is that the wind circulating under the ventilation structure tends to be deviated by the windscreen and directed vertically to the fans.

Although such a solution improves the efficacy of ACCs by reducing the harmful effects of strong winds, it is still not completely satisfactory.

AIM AND SUMMARY OF THE INVENTION

The main aim of the present invention is therefore to rectify such disadvantages by proposing a heat exchanger cooled by air whereof the efficacy is affected only slightly by surrounding weather conditions, and especially by the presence of wind.

This aim is attained by a heat exchanger cooled by air, comprising a plurality of ventilation modules arranged in several parallel rows, adjacent to one another and placed in the same horizontal plane to form a ventilation structure which is spaced from the ground so as to promote circulation of air under the ventilation structure, each ventilation module comprising a fan directed to aspire air present below the ventilation structure and blow it vertically through heat exchange elements, characterised in that it further comprises at least one rigid panel forming a windscreen which extends vertically from a lateral edge of the ventilation structure to the ground at a height between 5 and 50% of the distance separating the ventilation structure from the ground.

The presence of such a rigid panel according to the invention reduces degradation due to the presence of wind of the airflow aspirated by the fans of the exchanger. In fact, it has been noted that the addition of such a rigid panel positioned on at least one side of the ventilation structure creates a depression just behind the panel, making the vertical pull of air at this point easier (the airflow shifts from a horizontal direction to a vertical direction). The first row of ventilation modules exposed to the wind, normally the zone where the airflow aspirated by the fans is the most degraded, pulls a larger airflow because of this effect. Also, the more the force of the wind intensifies, the more the fans of the rows located downstream rediscover part of their initial performance due to adding such a rigid panel.

The presence of the rigid panel according to the invention also improves the performance of the heat exchanger cooled by air, even when the wind is zero. Potential air recirculation is also reduced. In fact, the presence of this rigid panel creates an added obstacle for possible aspiration of warm air leaving the exchanger, which limits performance degradation due to the presence of air made warmer at the intake of this exchanger.

The exchanger preferably has no wind deflection member between the ground and a lower end of the rigid panel forming a windscreen.

More preferably, the rigid panel forming a windscreen is placed on the side of the ventilation structure which is the most exposed to wind.

The ventilation structure can have a substantially rectangular form, the rigid panel forming a windscreen extending on one side of said ventilation structure. In this case, the exchanger can comprise rigid panels forming a windscreen extending on two, three or four sides of the ventilation structure.

More preferably still, the exchanger further comprises at least one supplementary rigid panel extending vertically upwards from a lateral edge of the ventilation structure.

Finally, the exchanger can constitute an air-cooled condenser of a thermal power station.

BRIEF DESCRIPTION OF THE DIAGRAMS

Other characteristics and advantages of the present invention will emerge from of the following description, in reference to the attached diagrams which illustrate embodiments having no limiting character. In the figures:

FIG. 2 is a vertical sectional view of the exchanger of FIG. 1;

FIGS. 3A and 3B show the effect of the presence of a rigid panel according to the invention on the airflow aspirated by the fans of the exchanger.

DETAILED DESCRIPTION OF EMBODIMENTS

Figure 1:
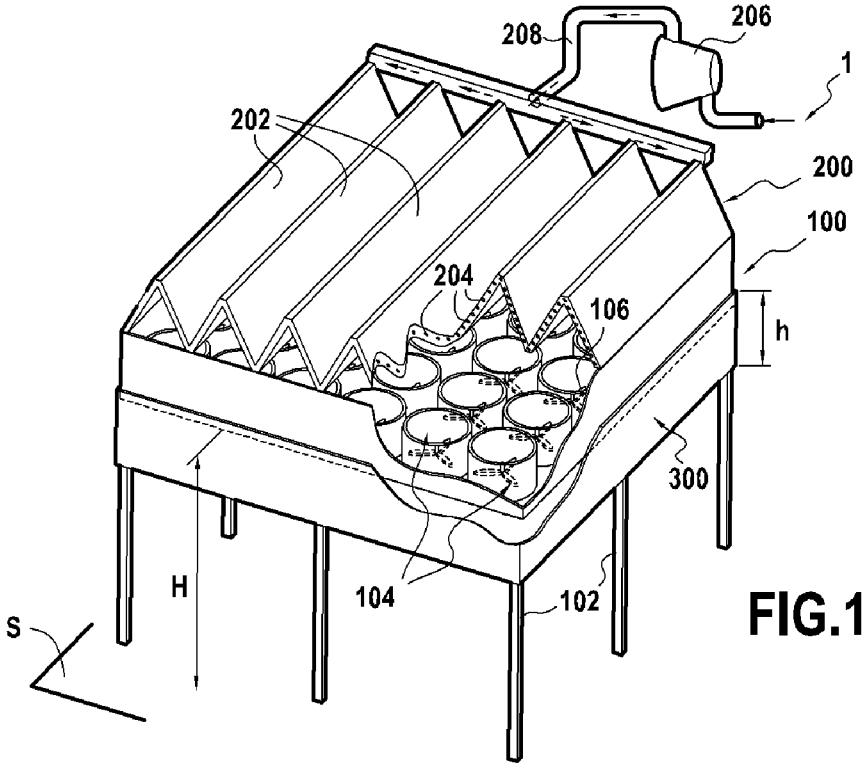
FIG. 1 is a schematic and perspective view of a heat exchanger cooled by air according to the invention.

The invention is applicable to different types of heat exchangers cooled by air, and especially to condensers cooled by air in thermal power stations, such as that illustrated in FIGS. 1 and 2.

The condenser air-cooled 1 especially comprises a ventilation structure 100 and a structure 200 carrying heat exchange elements placed above the ventilation structure.

The ventilation structure 100 which has a substantially rectangular form is supported by vertical feet 102 so as to be elevated relative to the ground S (by a height H of as up to 60 m). The space E formed between the ground S and the lower face of the ventilation structure allows air to circulate freely.

The ventilation structure 100 comprises several rows of ventilation modules 104 which are arranged parallel and adjacent to one another, each ventilation module 104 comprising a fan 106 with vertical axis of rotation 108. The rows of these ventilation modules 104 are placed in the same horizontal plane.

The structure 200 carrying heat exchange elements is known per se and therefore will not be described in detail. By way of example, this structure 200 can support a plurality of bundles of tubes 202 placed above the ventilation modules 104 and each enclosing a plurality of tubes with fins 204 in which steam to be condensed circulates. The latter is for example conveyed from the low-pressure turbine 206 of the thermal power station via a principal conduit 208.

The operation of such an air-cooled condenser is as follows. The steam to be condensed coming from the low-pressure turbine 206 of the thermal power station is conveyed by the principal conduit 208 and circulates transversally in the tubes with fins 204 positioned in the bundles of tubes 202. The fans 106 of the ventilation modules are directed so as to aspire air circulating in the space E and to blow it vertically onto the bundles of tubes enclosing the tubes with fins 204 to produce thermal exchange and condense the steam circulating in these tubes. The water coming from the condensation of the steam is evacuated via another circuit (not shown in the figures) to be recycled.

According to the invention, the air-cooled condenser 1 further comprises a rigid panel 300 forming a windscreen which extends vertically from a lateral edge of the ventilation structure to the ground at a height h between 5 and 50% of the distance separating the ventilation structure 100 from the ground S (and which correspond to the height H defined earlier).

Such a rigid panel 300 has several particular features. It is made especially from a material which makes it rigid, as opposed to a supple panel such as produced from fabric, for example. By way of example, this rigid panel can be made of various materials (metal, synthetic or other). The surface of the panel can be smooth or provided with reliefs.

Of course, the material used to make the rigid panel can potentially be elastic (for example, very fine metal sheeting which deforms under the effect of wind and which resumes its original form in the absence of wind can be used).

Also, the rigid panel 300 extends over an entire lateral edge of the ventilation structure 100. If the ventilation structure has the shape of a rectangle, as illustrated in FIGS. 1 and 2, the rigid panel extends on one of the sides of the rectangle.

This side is preferably selected to correspond to the side of the ventilation structure 100 which is normally the most exposed to wind (by comparison with other sides).

More preferably, as shown in FIGS. 1 and 2, the condenser cooled by air 1 comprises several rigid panels 300 which extend over the entire periphery of the ventilation structure, that is, each side of the ventilation structure comprises such a rigid panel.

Also, each rigid panel 300 extends vertically from the lower face of the ventilation structure and descends to the ground S. The height h over which each panel extends vertically is between 5 and 50%—and preferably between 25 and 35% of the height H.

It is evident that the condenser cooled by air according to the invention preferably has no panel or other wind deflection member between the lower limit of the rigid panels 300 and the ground S. Similarly, the condenser cooled by air according to the invention has no panel or other wind deflection member which can be placed between its lateral edges.

FIGS. 3A and 3B show the effect of the presence of a rigid panel 300 on the airflow of the fans 106 of a ventilation structure of a condenser cooled by air, this ventilation structure for example comprising thirty-six fans.

In these figures, airflow aspirated by a fan is high when it is strongly greyed. Similarly, airflow aspirated by a fan is weak when it is only slightly greyed.

FIG. 3A illustrates the airflow aspirated by the fans of the ventilation structure in the absence of a rigid panel according to the invention for wind from direction F and the speed of which is 2 m/s and 10 m/s.

FIG. 3A shows that in the absence of a rigid panel according to the invention, the airflow aspirated by the fans is strongly degraded, especially for fans located in the row directly exposed to wind. It is also evident that the higher the wind speed, the greater this degradation. This results in a drop in the performance of the condenser in strong wind.

In FIG. 3B, a rigid panel 300 having the characteristics of the invention is mounted on the side of the ventilation structure which is directly exposed to wind. It is evident that the presence of such a rigid panel substantially reduces the degradation of the airflow aspirated by the fans, and that of the first row (that is, the one directly behind the rigid panel). Also, the wind speed affects the performance of the fans much less due to the presence of the rigid panel according to the invention.

Figure 4:
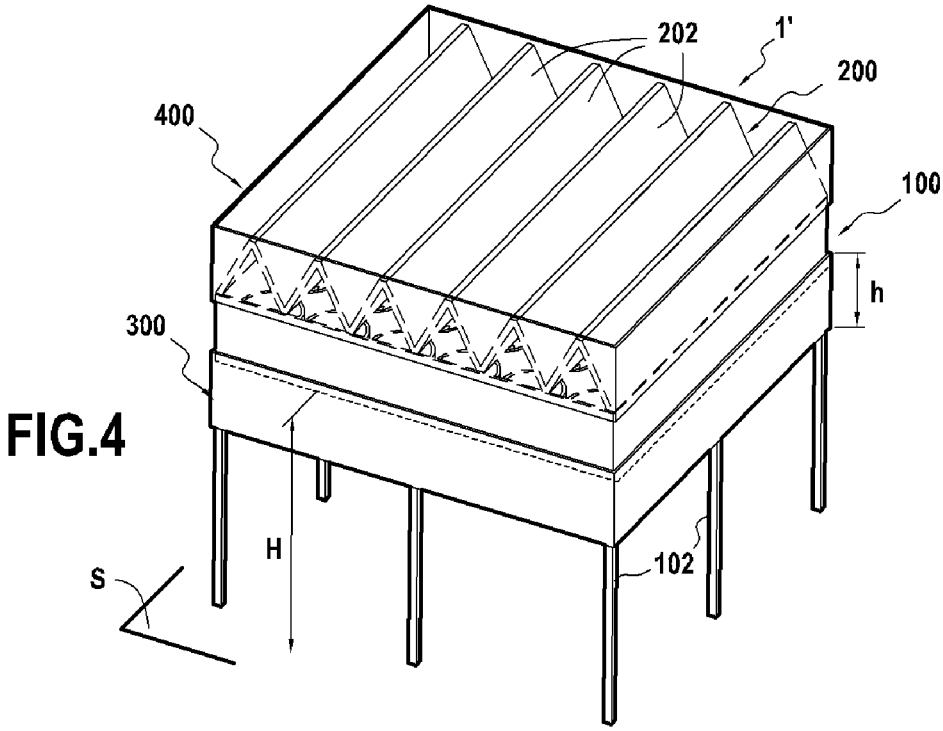
FIG. 4 is a schematic and perspective view of a heat exchanger cooled by air according to a variant embodiment of the invention.

In conjunction with FIG. 4, a variant embodiment of the condenser cooled by air according to the invention will now be described.

In this variant embodiment, the condenser cooled by air 1' further comprises at least one supplementary rigid panel 400 which extends vertically upwards from a lateral edge of the ventilation structure (that is, in the direction opposite the rigid panel 300).

For example, this supplementary panel 400 extends over the entire height on which the bundles of tubes 202 extend vertically, placed above the ventilation modules 104 and each enclosing the tubes with fins in which the steam to be condensed circulates. As for the rigid panel 300, it is an advantage to place such supplementary panels over the entire periphery of the ventilation structure.

The advantage of such a supplementary panel 400 is to improve vertical airflow swept by the fans, and create a chimney effect, easing the work of each fan.

The invention claimed is:

1. A heat exchanger cooled by air comprising a plurality of ventilation modules arranged in several parallel rows, adjacent to one another and placed in the same horizontal plane to form a ventilation structure which is spaced from the ground so as to promote circulation of air under the ventilation structure, each ventilation module comprising a fan directed to suction air present below the ventilation structure and blow it vertically through heat exchange elements, wherein the heat exchanger further comprises at least one rigid panel forming a windscreen which extends vertically from a lateral edge of the ventilation structure toward the ground to a height between 5% and 50% of the distance separating the ventilation structure from the ground.

2. The exchanger according to claim 1, wherein the heat exchanger has no wind deflection member between the ground and a lower end of the rigid panel forming a windscreen.

3. The exchanger according to claim 1, wherein the rigid panel forming a windscreen is placed to a side of the ventilation structure which is most exposed to a source of wind.

4. The exchanger according to claim 1, wherein the ventilation structure has a substantially rectangular form, the rigid panel forming a windscreen extending on one side of said ventilation structure.

5. The exchanger according to claim 4, further comprising rigid panels forming a windscreen extending on two, three or four sides of the ventilation structure.

6. The exchanger according to claim 1, further comprising at least one supplementary rigid panel extending vertically upwards from a lateral edge of the ventilation structure.

7. The exchanger according to claim 1, constituting an air-cooled condenser of a thermal power station.

* * * * *